United States Patent [19]

Johnson

[11] 4,359,035

[45] Nov. 16, 1982

[54] INTAKE MANIFOLD FUEL ATOMIZING SCREEN

[76] Inventor: Edward E. Johnson, 2107 Plymouth Rock, Richardson, Tex. 75081

[21] Appl. No.: 180,329

[22] Filed: Aug. 22, 1980

Related U.S. Application Data

[63] Continuation of Ser. No. 973,240, Dec. 29, 1978, abandoned.

[51] Int. Cl.[3] ..... F02M 29/00

[52] U.S. Cl. ..... 123/593; 123/573; 123/585

[58] Field of Search ..... 123/590, 593, 572, 573, 123/585, 587

[56] References Cited

U.S. PATENT DOCUMENTS

| | | | |
|---|---|---|---|
| 1,061,655 | 5/1913 | Bachman | 123/593 |
| 3,181,833 | 5/1965 | Adams et al. | 123/572 |
| 3,449,098 | 6/1969 | Larson | 123/593 |
| 3,682,608 | 8/1972 | Hicks | 123/593 |
| 3,885,539 | 5/1975 | Hicks | 123/593 |
| 4,022,176 | 5/1977 | Taylor | 123/593 |
| 4,023,544 | 5/1977 | Cole | 123/593 |
| 4,071,044 | 1/1978 | Jones | 123/573 |
| 4,091,786 | 5/1978 | Hartopp | 123/593 |

*Primary Examiner*—Ira S. Lazarus

[57] ABSTRACT

A dished screen placed in engine intake manifold openings beneath a carburetor in the path of intake air flow with, under a one-barrel carburetor one recess dished screen being used, and with a two-barrel carburetor two recess dished screens being used. The screen units are positioned so that fuel laden air from the carburetor passes through screening of the screen units with the mesh and wire size of the screening coupled with depressed dished shape of the screen units such as to optimize vaporization atomizing of fuel in the fuel air mixture being fed to the engine. The proper shape and screening size of the dished screen units is an excellent trade-off of intake air/fuel mixture flow obstruction for more efficient fuel utilization resulting in more power and significantly improved mileage and decreased undesired emissions.

7 Claims, 5 Drawing Figures

INTAKE MANIFOLD FUEL ATOMIZING SCREEN

Figure 1:
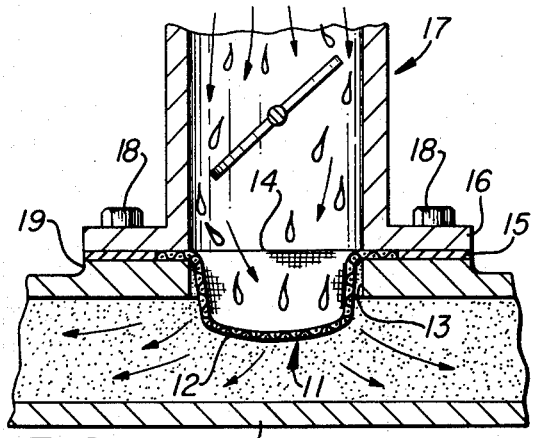

This is a continuation application Ser. No. 973,240, filed Dec. 29, 1978, now abandoned.

This invention relates in general to vaporization of liquid fuel fed to internal combustion engines and, in particular, to a liquid fuel vaporizing screen unit used singly or in multiple depending upon whether a carburetor is a one-barrel or multi-barrel carburetor feeding corresponding intake manifold openings. Each screen unit is positioned in a manifold intake opening such that fuel laden air from the carburetor passes through screening of the screen units with screen mesh and wire size coupled with depressed dish shape of the screen units such as to optimize vaporization atomizing of fuel in the fuel air mixture being fed to the engine.

Fuel economy is an increasingly important consideration in vehicles, particularly with present energy problems and fuel shortages and constantly increasing fuel costs. Further, present day problems of environmental pollution have resulted in legislative action requiring more efficient engines with less pollution to meet tighter emission standards. In meeting such standards, exhaust gas recirculation, catalytic converters and/or auxiliary pumps and other associated controls are designed into vehicles, both passengers cars and trucks, resulting in greatly increased vehicle costs. Still further, addition of such additional pollution control equipment is a further power drain on the vehicle engine further decreasing efficiency. Obviously, if engine efficiency can be increased to the point that pollution control devices are no longer needed in meeting tightened pollution standards still further increases in efficiency are attainable through the lessened power loading with removal of driven equipment. If engine efficiency is such that catalytic converters and/or other pollution control devices are not needed then the range of fuels useable is expanded and the engine may be tuned for optimum engine efficiency and not for optimized pollution control device efficiency.

With engines employing conventional carburetors for fuel vaporization a portion of the intake air is used to break the fuel into fine droplets. Since droplet size varies with intake air speed and intake air speed varies over a wide range droplet size varies from smaller droplets are higher intake air speeds to larger droplets at lowr intake air speeds. It should be noted that there is some beneficial gasification of the fuel in the carburetor and delivery through intake manifolding. However, much of the fuel remains in the form of droplets of varying sizes passed into the intake manifold with much of air fuel mixing occurring downstream from the carburetor resulting in uneven cylinder to cylinder distribution. More complete vaporization of the fuel leads to more uniform mixing of fuel with air in the carburetor area and through the engine intake manifold. Further, the more completely fuel is transformed to a vapor as opposed to a mist droplet state the efficiency of combustion in the cylinder is improved.

It is, therefore, a principal object of this invention to provide improved engine fuel feed gas vaporization.

Another object is to attain increased vehicle mileage with reduced emission pollution.

A further object is to so increase vehicle internal combustion engine efficiency as to permit removal of emission pollution control devices and still meet tightened emission pollution standards.

Features of this invention useful in accomplishing the above objects include a carburetor on an intake manifold of an internal combustion engine with a screen unit mounted in at least one intake manifold opening held in place along with gasketing between the carburetor and the intake manifold. Each screen unit is dished downward to not only clear carburetor components if necessary but to also increase screen area for passage of air and fuel. This coupled with optimal screen mesh and wire size is such as to optimize vaporization atomizing of fuel in the fuel air mixture being fed to the engine.

Specific embodiments representing what are presently regarded as the best modes of carrying out the invention are illustrated in the accompanying drawing.

In the drawing

Figure 2:
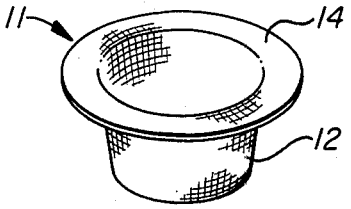
Figure 3:
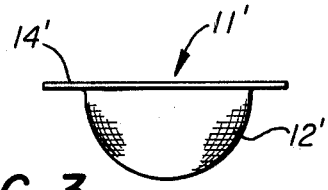
Figure 4:
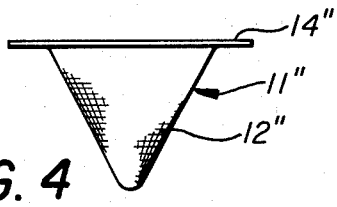
Figure 5:
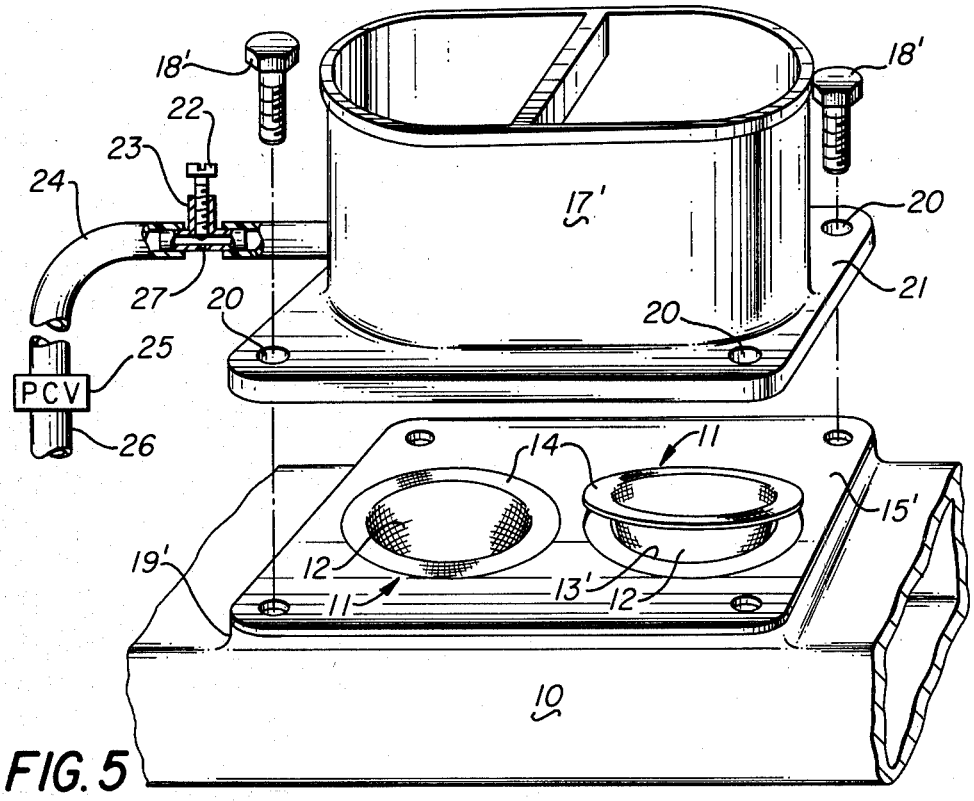

FIG. 1 represents a partially broken away and sectioned elevation view of a carburetor mounted on an intake manifold with an air/liquid fuel vaporizing screen unit positioned in an intake opening of the intake manifold with the mounting flange of the screen unit held between the carburetor mounting boss of the intake manifold and the mounting base of the carburetor;

FIG. 2, a perspective view of a screen unit as used in the carburetor intake manifold assembly of FIG. 1;

FIGS. 3 and 4, side elevation views of other screen unit configuration embodiments that may be used in intake manifold openings in place of the screen unit of FIGS. 1 and 2; and, FIG. 5, an exploded perspective view of a two-barrel carburetor and intake manifold combination also including an air valve in a (PCV) positive crankcase ventilation system control valve line.

Referring to the drawing

The intake manifold 10 fuel atomizing screen unit 11 of FIGS. 1 and 2 is shown to be held in place with the dished bowl 12 thereof extending down into and through intake opening 13 of the engine intake manifold 10 with annular screen flange 14 tightly held in place by carburetor gasket 15 clamped under the mounting flange 16 of carburetor 17, fastened by bolts 18 to the carburetor mounting boss 19 of the intake manifold 10. The screen unit 11' of FIG. 2 is an alternate screen unit embodiment with a rounded hemospheric like formed depression 12' depending from annular flange 14' with screen unit 11' useable in place of screen unit 11 in the intake manifold-one barrel carburetor combination of FIG. 1 or in a plurality of intake openings 13' such as with the two barrel carburetor 17' and intake manifold 10' combination of FIG. 5. In like manner the alternate screen unit 11'' embodiment of FIG. 4 having a conical depression 12'' depending from annular flange 14'' may be used in the combination of FIG. 1 or that of FIG. 5 in place of the screen units 11 or 11'.

Screen units 11, 11' or 11'', which may also be called screen baskets, may be formed to fit different engine intake manifold openings 13 but a typical screen unit size at the depression perimeter diameter is approximately one and one-half inches, a flange extension of about one quarter of an inch and a bowl depth of approximately these quarters of an inch. Stainless steel wire or copper wire screen mesh up to at most coarse a 30—30 mesh screen having up to a maximum wire diameter of a 0.020 inches is usable with however a 60-40 mesh of 0.010 inch diameter wire having proven to be a particularly good screen mesh from which screen units 11, 11' or 11'' may be formed in providing excellent operational results. The screen units intercept course fuel droplets dispersed in the airstream and atomize the fuel droplets in turbulence in the screen and about the wires of the screen units in creating a suspension of minute fuel particles in the air downstream from the screen units in an air/fuel mist flowing to the cylinders through the intake manifold 10 as shown diagrammatically in FIG. 1. The downward depressed dishes or bowls of screen units 11, 11' or 11" increase the screen area for passage of fuel/air mixture therethrough with minimized obstruction to through flow of fuel laden air to the engine cylinders. Test with a number of automobiles have shown beneficial operational results with mileage increase generally falling in a range of 20% to 50% increase. This also, with more complete burning of fuel in the engine, results in improved significant reduction of noxious contaminant emissions. It is of interest to note that the downward depending walls of screen units 11, 11' and 11" extend inward and away from the walls of intake manifold openings 13 in FIG. 1 or 13' in FIG. 5 in insuring that the full area of the downward formed depressions or bowls be effective in passing fuel and air mixture through flow.

Screen units 11, 11' and 11" and in other variation modifications thereof to fit various intake manifold openings under carburetors for various engines are useable not only with a single-barrel carburetor such as in FIG. 1, but with two-barrel carburetors 17' and a two-intake-hole 13' manifold 10' such as in FIG. 5. Obviously, screen units 11, 11' and 11" may also be used with four-barrel carburetors (not shown) in much the same manner with, in some instances, screen units used in only the two front intake manifold openings and in others in all four manifold openings. In the two-barrel carburetor showing of FIG. 5 the screen units 11 are shown as being in place with flanges 14 above gasket 15' rather than below gasket 15 as shown in FIG. 1. With screen units 11 in place the carburetor 17' is fastened in place with bolts 18' extended through holes 20 in carburetor mounting flange 21 into intake manifold carburetor mounting boss 19'. With this installation of FIG. 5 a set screw 22 adjustable vacuum T unit 23 is inserted in line 24 interconnecting PCV valve 25 and carburetor 17' and on through line 26 to the engine for passage of engine crankcase blow-by gases back to the carburetor 17' and fed into the intake air flow.

The set screw 22 of vacuum T unit 23 in line 24 is set to achieve fast idle with air bleed through the vacuum T 23 bleed opening 27 to line 24. Then after adjusting set screw 22 the carburetor linkage is set to idle in accord with factory specifications.

With two screen units 11 (11' or 11") and a vacuum T furnished as a field modification kit installation is made as follows:

1. Remove carburetor.
2. Insert baskets into intake manifold in front two holes, if you have a 4-barrel carburetor. If you have a 2-barrel carburetor, insert the screen baskets in the two holes under carburetor.
3. Replace carburetor. (Make sure you have the right carburetor gasket.)
4. Start motor and check for vacuum leak.
5. Insert Vacuum T into PCV vacuum line.
6. Adjust set screw on top of T to acehive fast idle.
7. After adjusting set screw make sure you set carburetor linkage idle to factory specifications.

To insert T into PCV vacuum line, cut rubber line with knife. (No clamps are necessary.)

Please note that with factory installation carburetors may be provided with an air bleed adjustment eliminating the requirement for addiation of a vacuum T 23 in a PCV line 24.

Whereas this invention is herein illustrated and described with respect to several embodiments thereof, it should be realized that various changes may be made without departing from essential contributions to the art made by the teachings hereof.

I claim:

1. In an internal combustion engine intake manifold system having openings beneath engine carburetors and a PCV vacuum flow line communicating the PCV valve with the vacuum inlet of the intake manifold system: a screen unit of relatively fine mesh screening of at most a 30—30 mesh screen with maximum wire diameter of 0.020 inches having a depending formed depression sized to fit the intake opening of the intake manifold beneath a barrel of a carburetor with the depending formed depression extending down and away from the carburetor; a mounting flange surrounding the depending formed depression sized to be clamped with a carburetor gasket between the carburetor mounting boss on the intake manifold; wherein said depending formed depression has walls angled inward and away from the wall of said intake opening, and an adjustable air vacuum valve "T" fitting with an air bleed opening into the PCV vacuum line, said screen unit and "T" fitting cooperating to establish and to maintain a predetermined air/fuel combustion mixture ratio for the intake manifold system.

2. The fuel atomizing screen of claim 1, wherein said depending formed depression is a depressed dish shape.

3. The fuel atomizing screen of claim 1, wherein said depending formed depression is a depressed rounded hemospheric-like formed depression.

4. The fuel atomizing screen of claim 1, wherein said depending formed depression is generally a conical depression.

5. The fuel atomizing screen of claim 1, wherein said screen unit is formed of one piece of approximately 60–40 mesh screening of approximately 0.010 inch diameter wire.

6. The fuel atomizing screen of claim 1, wherein said screen unit is formed of stainless steel wire screening.

7. The system of claim 1 wherein said mounting flange is an annular extension of the mesh forming said depending formed depression.

* * * * *